United States Patent [19]

Gross

[11] 4,378,192

[45] Mar. 29, 1983

[54] VEHICULAR LIFT MECHANISM FOR TRANSPORTING LARGE STRUCTURAL MEMBERS

[75] Inventor: Herwig P. Gross, Munich, Fed. Rep. of Germany

[73] Assignee: Dyckerhoff & Widmann Aktiengesellschaft, Munich, Fed. Rep. of Germany

[21] Appl. No.: 195,853

[22] Filed: Oct. 10, 1980

[30] Foreign Application Priority Data

Oct. 13, 1979 [DE] Fed. Rep. of Germany ..... 2941611

[51] Int. Cl.[3] ..... B66F 9/22

[52] U.S. Cl. ..... 414/546; 414/700; 414/708; 414/910

[58] Field of Search ..... 414/546, 910, 700, 706, 414/708, 469

[56] References Cited

U.S. PATENT DOCUMENTS 3,297,183 1/1967 Klaviter ..... 414/708

4,266,909 5/1981 Langenfeld ..... 414/708 X

*Primary Examiner*—Richard A. Schacher

*Attorney, Agent, or Firm*—Toren, McGeady and Stanger

[57] ABSTRACT

A transport vehicle particularly for moving large structural members such as prefabricated concrete enclosures is provided with a lifting device which may be moved in the longitudinal direction of the vehicle and which consists of a support arm pivotal about a first axis extending transversely to the longitudinal direction of the vehicle. The support arm is arranged to be inserted into an enclosure or other load to be transported by an end thereof opposite said first axis which has a support device thereon pivotally mounted for rotation about a second axis parallel to said first axis. In order to ensure that the load is always maintained at a constant angular position relative to the plane of the vehicle when the support arm is pivoted about the first axis, a first cylinder-piston unit is connected between the support arm and the vehicle and a second cylinder-piston unit is connected between the support arm and the support device, each of the cylinder-piston units having the same displacement and being arranged with a certain leverage with the corresponding fluid volumes defined by the cylinders of each of the cylinder-piston units being connected to each other in fluid communication.

9 Claims, 11 Drawing Figures

VEHICULAR LIFT MECHANISM FOR TRANSPORTING LARGE STRUCTURAL MEMBERS

The present invention relates generally to transport vehicles particularly for transporting large structural members or spatial cells which are usually open at least at one end thereof such as, for example, prefabricated reinforced concrete enclosures.

The device of the invention involves a vehicle having a lifting device mounted thereon which may be moved relative to the vehicle in the longitudinal direction thereof. The lifting device is composed of a support arm pivotally mounted on a bearing bracket for pivotal movement about a swing axle extending transversely to the longitudinal axis of the vehicle. The support arm is adapted to be moved into the structural member to be transported with an end thereof upon which there is arranged a support device which is also pivotable relative to the support arm about an axis parallel to the swing axis of the support arm.

In known transport vehicles of the type to which the present invention relates, the transport arm is in the form of a single lever arm which may be swung about an axle which is arranged immediately behind the driver's cabin of the vehicle. The swinging movement is effected by means of a hydraulic unit having a vertical direction of action and arranged behind the axle for swinging the lever in the longitudinal direction of the vehicle (see German Offenlegungsschrift No. 26 33 683). The support device for the prefabricated structural enclosure consists of a transverse rod arranged at the end of the support arm. The transverse rod is provided with heads at its end faces. Ropes fastened at the heads may be fastened to holders at the bottom of the structural enclosure to be transported. The support device may be swung about an axis extending transversely of the vehicle axis.

Aside from the suspension of the prefabricated structural member at the bottom thereof, it is also known to arrange a support device at the end of the support arm of such a vehicle, which support device bears against the underside of the upper wall of the prefabricated structural member (see German Offenlegungsschrift No. 21 41 522). This support device may also be swung about an axis which extends transversely to the longitudinal direction of the vehicle.

In prior art transport vehicles of the types mentioned above, the prefabricated structural enclosure is raised and lowered by swinging the support arm in a vertical plane. When the support device which effects connection to the prefabricated structure is supported in an articulated manner at the end of the support arm, the prefabricated structure maintains its parallel position relative to the vehicle frame and relative to the ground only if it is supported exactly at the center of gravity thereof. Experience has shown that this is very difficult to achieve and, as a result, the swinging movement of the structure to be transported must be positively controlled or prevented. In this case, it is practically impossible to achieve synchronization of the swinging movement of the support device with swinging movement of the support arm.

The invention is directed toward the task of enabling the prefabricated structural member which is to be transported to be guided and supported by the support arm so that it will always be maintained in a desired orientation, e.g., parallel to the vehicle frame, regardless of the swinging movement of the support arm.

SUMMARY OF THE INVENTION

Briefly, the present invention may be defined as a vehicular assembly for transporting large structural loads, such as prefabricated concrete enclosures, comprising vehicle means, a longitudinal support arm having a first and a second end and pivotally mounted at said first end for pivotal movement relative to said vehicle means about a first axis extending transversely to the longitudinal direction of the support arm, a support mechanism for engaging a load to be transported pivotally mounted at said second end of said support arm for pivotal movement about a second axis parallel to said first axis, actuating or drive means operatively engaged between the vehicle means and the support arm for driving the support arm about the first axis to transport a load, first fluidic piston-cylinder means pivotally interconnected between the support arm and the vehicle means at the first end of the support arm, second fluidic piston-cylinder means pivotally interconnected between the support arm and the support mechanism at the second end of the support arm, and means operatively interconnecting the first and second fluidic piston-cylinder means in fluid communication with each other to maintain the support mechanism in a desired orientation relative to the vehicle means during operative movement of the support arm about the first pivot axis.

The first and second fluidic piston-cylinder means may comprise cylinder-piston units having the same displacement and arranged with a certain leverage with the corresponding working volumes of both cylinder-piston units being connected to each other in fluid communication. In a preferred embodiment of the invention, the cylinder-piston units are advantageously arranged in mirror-inverted relationship relative to each other.

The support arm may be pivotally connected to the vehicle means at the first end thereof by a bearing bracket and each of the cylinder-piston units is connected by pivotal joints at opposite ends thereof. The distances of the joints which connect the cylinder-piston unit to the bearing bracket or to the support arm taken relative to the swing axle of the support arm are equal to the distances of the joints by means of which the cylinder-piston unit is connected to the projection or the support arm from the swing axis of the support device.

The support device may comprise a lifting table which is formed of two longitudinal support members connected by means of a cross bar. Advantageously, the lifting table is supported so as to be vertically adjustable relative to the swing axis and it may be supported on telescoping posts.

A further advantage may be provided in the structure of the present invention if the second end of the support arm which carries the support mechanism is adapted to be rotated about the longitudinal axis of the support arm. An eccentrically arranged cylinder-piston unit may be provided for actuation of this swing movement.

During the swing movement of the support arm, the piston of the first cylinder-piston unit, which is connected to the support arm and to the vehicle frame, will be positively guided. Due to the fact that the second cylinder-piston unit, which is connected between the support arm and the support mechanism, has the same displacement as the first unit, and since it is hinged with the same lever arms, with the corresponding cylinder volumes being connected in fluid communication with each other, it is possible to achieve a result wherein the hydraulic medium which is displaced during the piston stroke of the first unit is forced into the cylinder volume of the second unit so that the support mechanism performs a corresponding swinging movement about its axis whereby the prefabricated construction member or other load will always be guided parallel with the loading surface of the vehicle even during swinging movements of the support arm.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
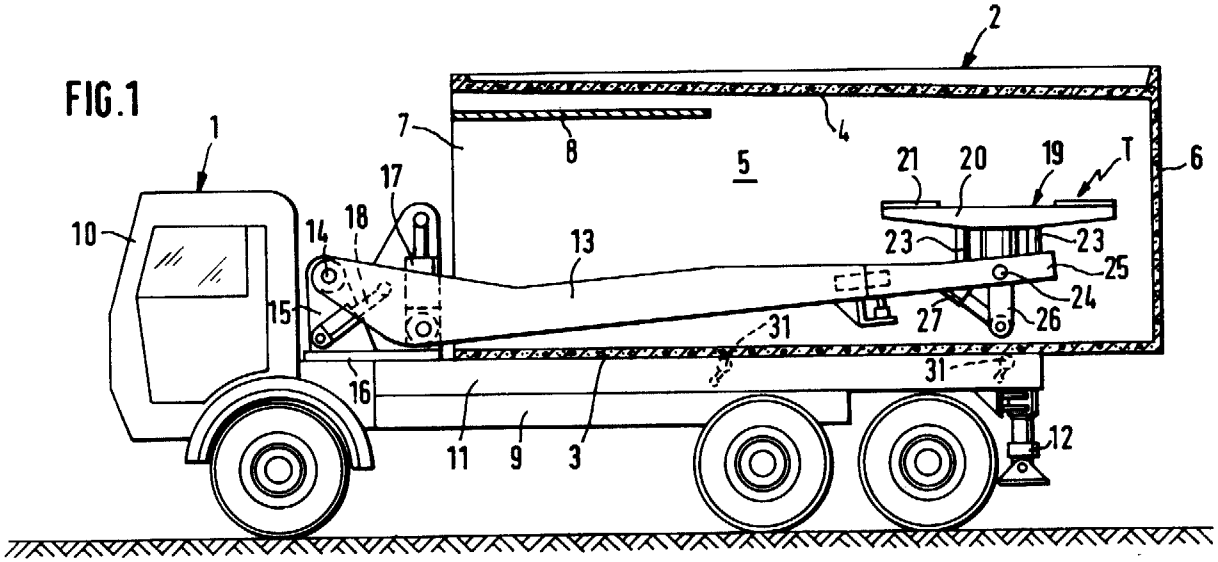
FIG. 1 is a side view partially in section of a transport vehicle with a structural member in the form of a prefabricated garage loaded thereupon for transportation.

Referring now to the drawings wherein similar reference numerals are used to identify like parts throughout the various figures thereof, there is shown a vehicle identified generally with reference numeral 1 which may operate to transport large structural members or spatial cells such as prefabricated garages made of reinforced concrete. In the drawings, an example of such a prefabricated garage 2 is shown as provided with a continuous bottom plate 3, a top plate 4, side walls 5 and a rear wall 6. The garage or load which is to be transported by the vehicle of the present invention includes a door 8 arranged in the region of a door opening 7.

The vehicle 1 is composed in its basic structure of a vehicle frame 9 with a driver's cabin 10 arranged in the forward region thereof. A pair of rails 11 are fastened parallel to each other in the longitudinal direction of the vehicle frame 9 and two extensible hydraulic support jacks 12 are arranged at the rearward end of the vehicle frame.

The basic element of the mechanism of the invention is a support arm 13 which is arranged on the vehicle so as to be movable along the rails 11. The support arm 13 may be swung about a first swing axis or axle 14 which is arranged horizontally and which extends transversely to the longitudinal axis of the vehicle. The swing axle 14 is supported on a bearing bracket 15 which is attached on a turning ring 16 mounted on the vehicle. The turning ring 16 is connected to a carriage which may be moved horizontally by means of moving gear on the rails 11. The carriage and the moving gear whereby the turning ring 16 may be moved longitudinally along the rails 11 are not part of the essential features of the invention and they are therefore not illustrated in detail. The carriage is preferably moved by means of a hydraulically actuated chain hoist (not shown).

The support arm 13 may be driven for pivotal movement about the axle 14 in order to raise and lower a load by driving or actuating means which may be comprised of a hydraulically operated cylinder-piston unit 17 mounted on the turning ring 16 and spaced a distance from the bearing bracket 15. By operation of the unit 17, the support arm may be rotated in a vertical plane about the axle 14.

In addition to the unit 17, a pair of fluidic cylinder-piston units 18 and 27 are also provided in operative engagement with the support arm 13 in order to effect a control function whereby a support mechanism T of the assembly of the invention may be retained in a constant particular orientation relative to the vehicle frame 9 during pivotal movement of the arm 13 about the axle 14.

The support device T upon which the load or prefabricated garage 2 is supported at the end of the support arm 13 consists essentially of a lifting table 19 with a pair of longitudinal support members 20 at whose ends there are provided support plates 21. The longitudinal support members 20 are supported at a second end 25 of the support arm 13 by a cross bar 22 and telescoping posts 23 so as to be rotatable about a swing axle 24. The lifting table 19 has a projection 26 extending from the bottom thereof with the piston rod of the second cylinder-piston unit 27 being fastened to the projection 26, with the other end of the cylinder-piston unit 27 being connected in an articulated manner to the end portion 25 of the support arm 13.

Figure 7:
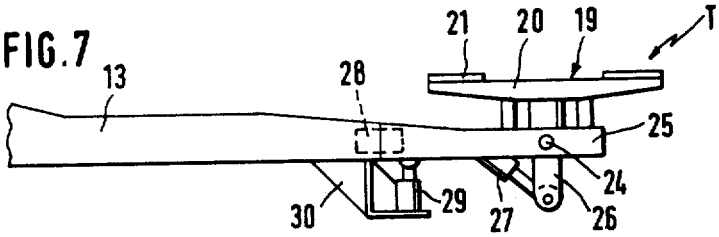
FIG. 7 is a side view showing in greater detail the lifting table at the end of the support arm.
Figure 8:
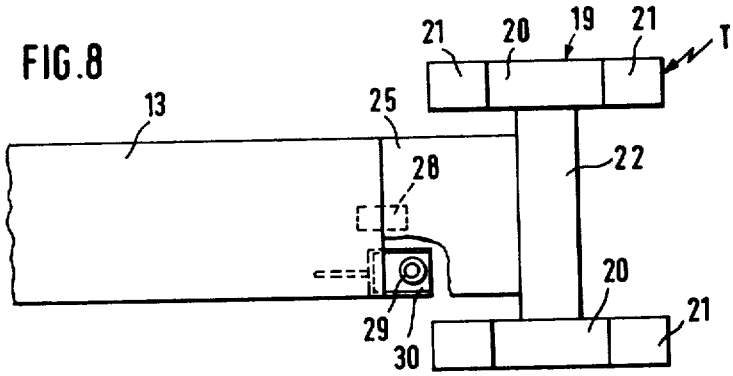
FIG. 8 is a top view of the lifting table depicted in FIG. 7.
Figure 9:
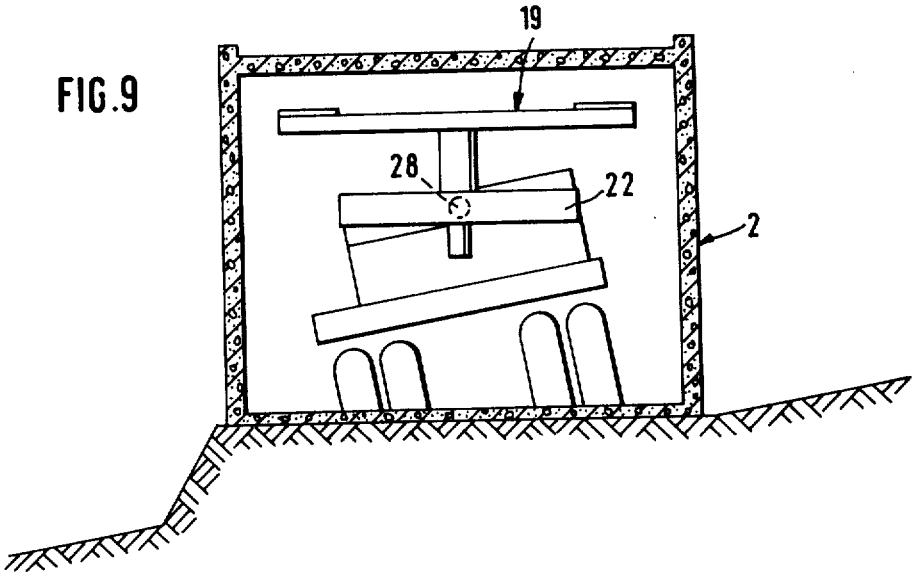
FIG. 9 is a schematic view partially in section showing the load being deposited on inclined terrain.

The end portion 25 of the support arm 13 is connected to the main portion of the arm 13 by means of a pivot pin 28 so that the portion 25 may be rotated about the longitudinal axis of the arm 13, as best seen in FIGS. 7 and 8. In order to perform rotational movement about the axis of the pin 28, a cylinder-piston unit 29 is arranged eccentrically upon a bracket 30. As a result of this rotative capability, a load such as the prefabricated garage 2 may be placed upon a ground location with a horizontal bottom surface even if the vehicle itself is stopped on sloping terrain extending transversely to the axis of the vehicle. This condition is depicted in FIG. 9.

The individual stages for transporting and depositing a load by means of the transport vehicle 1 are illustrated in FIGS. 1 through 6. FIG. 1 shows the load in the form of a prefabricated garage 2 during transporting thereof from one location to another. The prefabricated garage 2 rests upon the vehicle on the rails 11. By means of retractable and at least partially driven rollers 31, the prefabricated garage 2 may be moved in the longitudinal direction of the vehicle and it may be brought into a position at which the lifting table 19 may act at least approximately at the center of gravity thereof.

Figure 2:
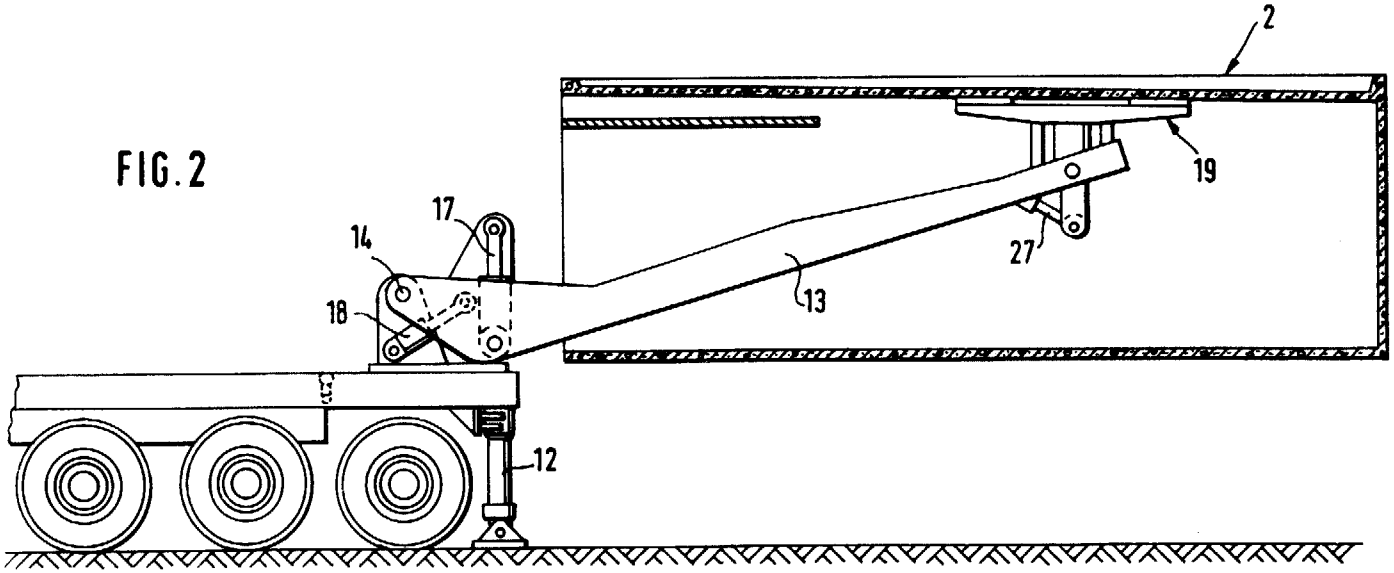
FIG. 2 is a side view showing the load mounted on an extended support arm of the transport vehicle prior to being unloaded.
Figure 3:
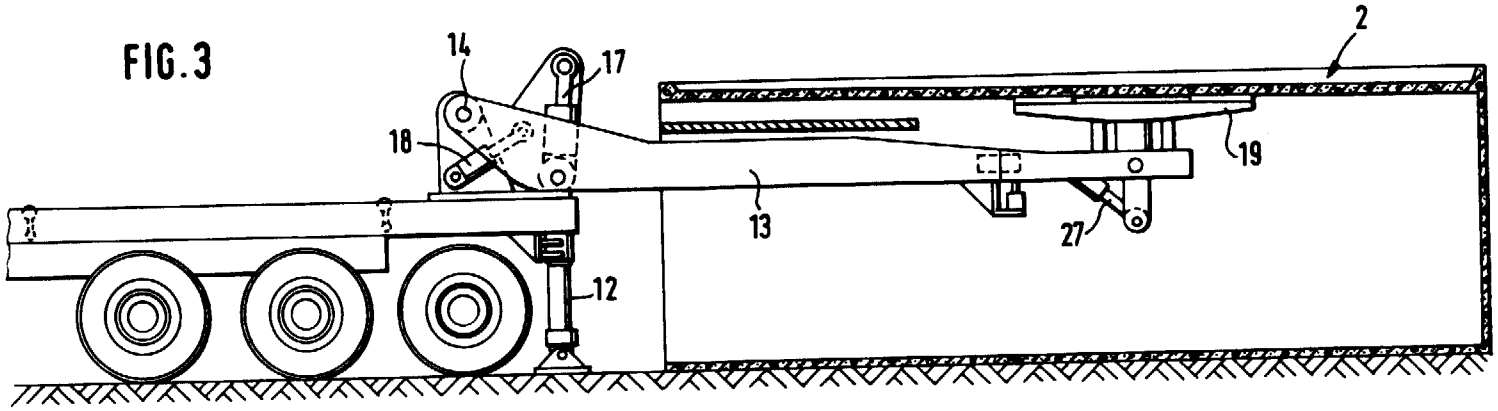
FIG. 3 is a side view showing the support arm of the transport vehicle in a position where the load is deposited at a desired location.
Figure 4:
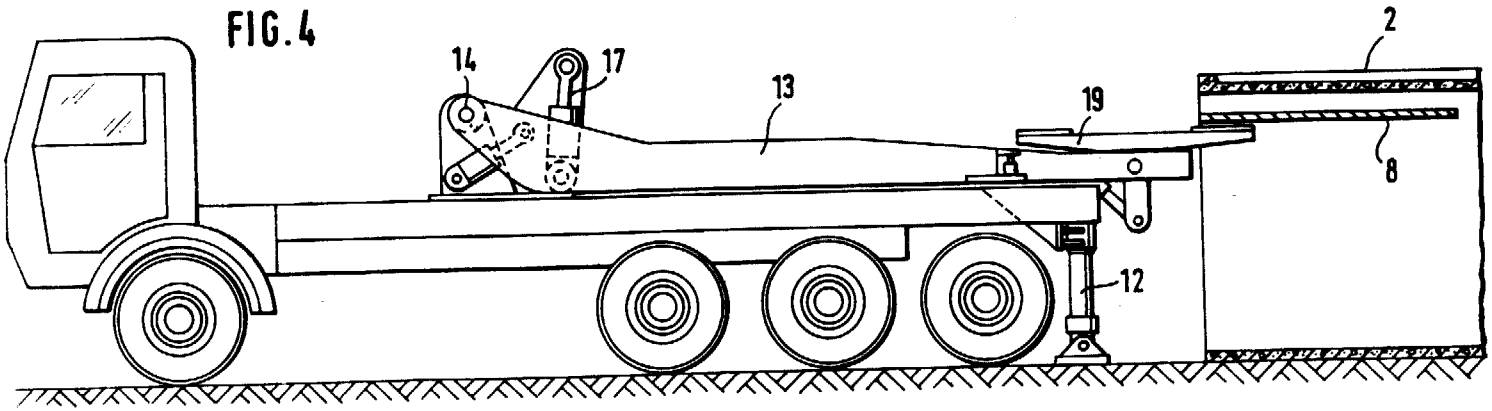
FIG. 4 is a side view of the transport vehicle shown during retraction of the support arm.

The prefabricated garage 2 may be raised with the lifting table 19 upwardly extended and with the support jacks 12 extended downwardly and it may be held rearwardly suspended behind the transport vehicle by extending the support arm 13, as shown in FIG. 2. By swinging the support arm 13 downwardly by operation of the drive means comprised of the cylinder-piston unit 17, the garage 2 may be placed upon the ground at a desired location, as shown in FIG. 3. The effect of the intercommunicating cylinder-piston units 18, 27 will cause the garage 2 to be guided in an orientation wherein it will be maintained parallel to the loading surface of the vehicle 2, i.e., parallel to the rails 11. In order to be able to subsequently retract the support arm 13, the lifting table 19 may be lowered relative to the support arm 13 so that the arm 13 may be moved outwardly beneath the door 8 of the garage 2, as shown in FIG. 4.

Figure 5:
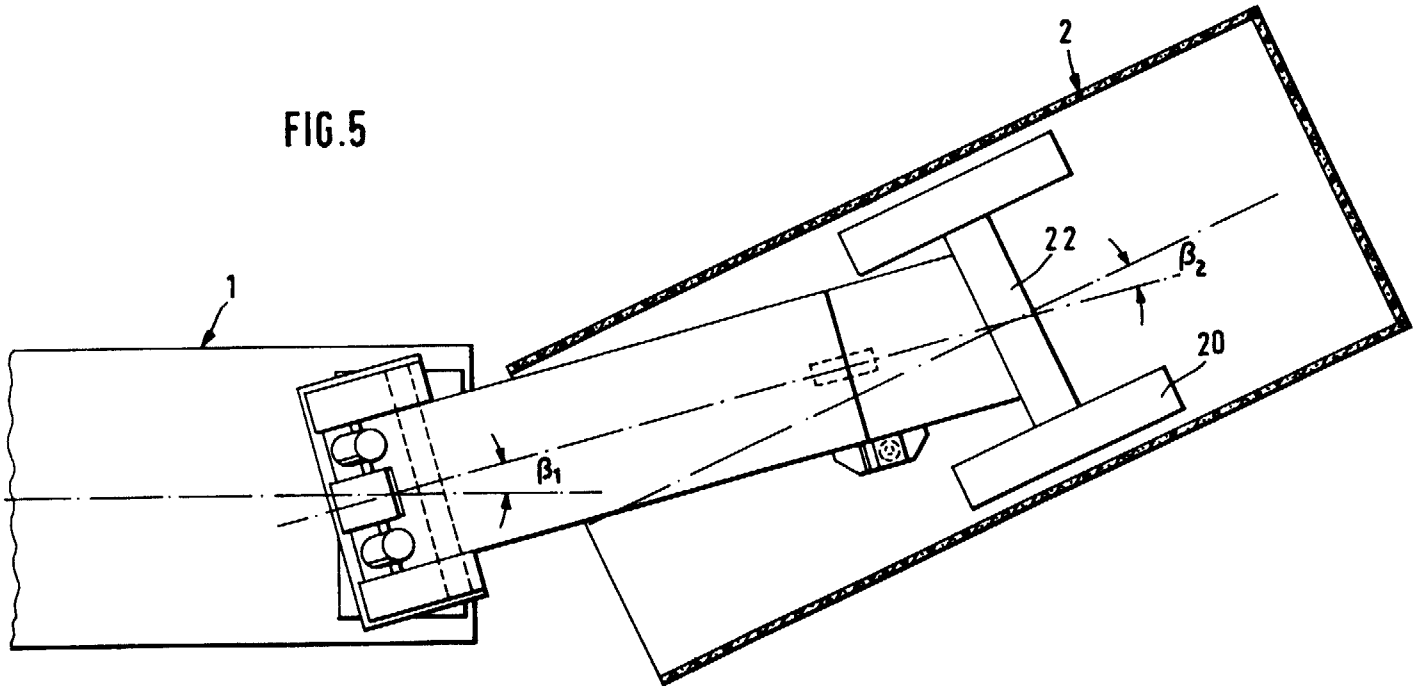
FIG. 5 is a top view showing the support arm and the load arranged in an angular position.
Figure 6:
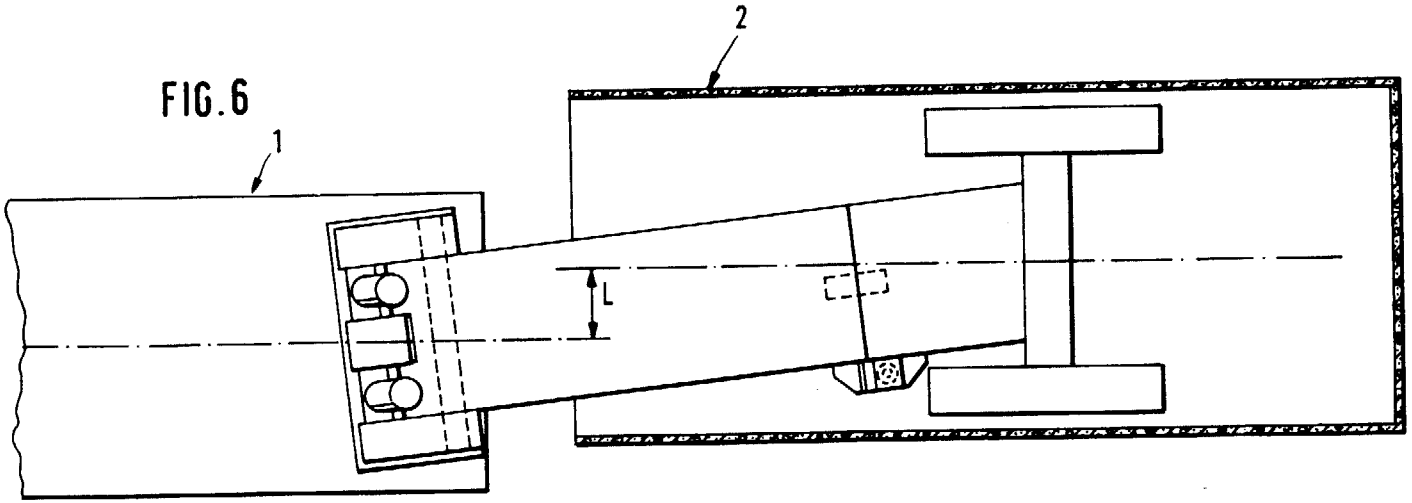
FIG. 6 is a top view showing the support arm and the load in a laterally offset position.

As a result of the arrangement of the mechanism of the invention whereby the support arm 13 is rotatably mounted relative to the vehicle by means of the turning table 16, and further in view of the fact that the lifting table 19 is mounted for rotation about a vertical axis, the garage 2 may be angularly moved relative to the vehicle through an angular displacement which will include the sum of two angles $\beta_1$ and $\beta_2$, as best seen in FIG. 5. Additionally, it will be clear that the garage or load 2 may be laterally displaced relative to the vehicle through a distance L, as shown in FIG. 6.

Figure 10:
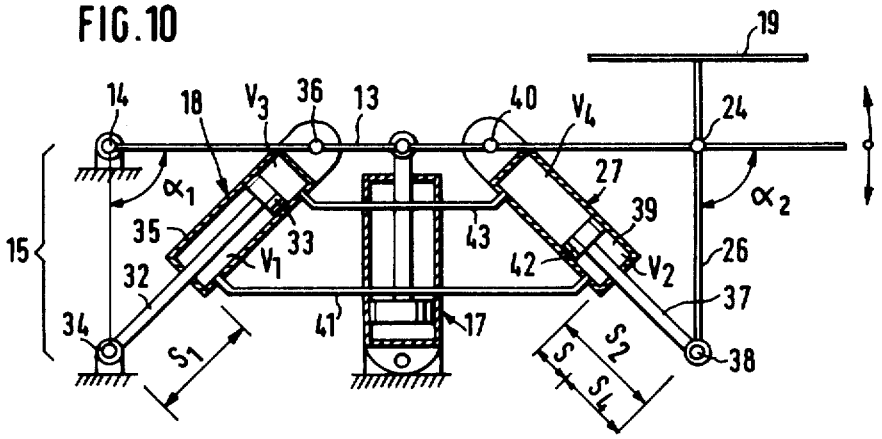
FIGS. 10 and 11 are schematic diagrams illustrating automatic control of the lifting mechanism in two different positions.
Figure 11:
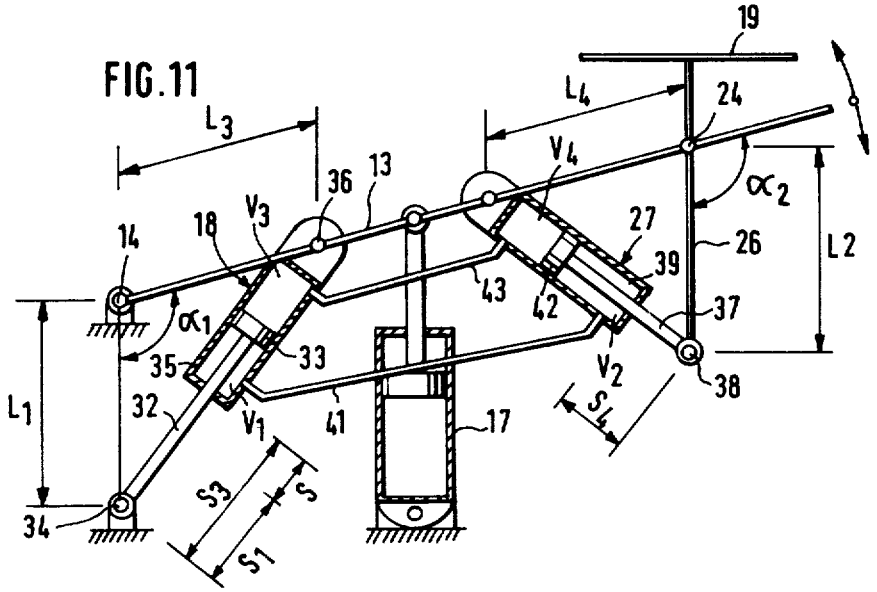

The control of the parallel guidance of the load during swinging movements of the support arm 13 is schematically illustrated in FIGS. 10 and 11. As seen therein, the cylinder-piston unit 18 includes a piston rod 32 which is pivotally fastened at a joint 34 on the bearing bracket 15. A cylinder 35 of the unit 18 is pivotally connected at a joint 36 to the support arm 13.

In the same manner, the cylinder-piston unit 27 includes a piston rod 37 which is pivotally connected at a joint 38 upon the projection 26 of the lifting table 19. The unit 27 also includes a cylinder 39 which is pivotally connected at a joint 40 to the support arm 13.

In order to ensure that the lifting table 19 will always be maintained in a position parallel to the loading surface of the vehicle 1, an angle $\alpha_1$ between the support arm 13 and a connecting line between the joints 14 and 34 must be maintained equal to an angle $\alpha_2$ between the support arm 13 and the projection 26 of the lifting table 19. Accordingly, if the support arm 13 is pivoted by means of the cylinder-piston unit 17, as shown in FIG. 11, a piston 33 of the cylinder-piston unit 18 will be moved accordingly. As a result, a certain fluid volume V of the oil or hydraulic fluid in the unit 18 will be displaced from a cylinder volume $V_1$ of the unit 18 and it will be passed under pressure through a line 41 into a corresponding cylinder volume $V_2$ of the cylinder-piston unit 27.

The cylinders 35 and 39 of the cylinder-piston units 18 and 27, respectively, are arranged to have the same displacement. Accordingly, a certain hydraulic fluid or oil volume V will correspond to a certain relative shift S between the cylinder and piston of each of the cylinder-piston units 18, 27. In a cylinder volume $V_2$ of the cylinder-piston unit 27, the oil volume V entering through the line 41 will correspond to the volume displaced from the cylinder-piston unit 18. In the unit 27, the oil will act upon a piston 42 and will cause the piston to travel a distance corresponding to the distance S. Since the lever lengths $L_1$ and $L_2$, as well as the lever lengths $L_3$ and $L_4$, are each equal, the units 18 and 27 are connected congruently relative to the axes 14 and 24, respectively, and thus the angle $\alpha_1$ will always correspond to the angle $\alpha_2$. Accordingly, the lifting table 19 will always be maintained parallel to the support surface of the vehicle.

Of course, it should also be noted that the units 18 and 27 also include volumes $V_3$ and $V_4$ on opposite sides of their respective pistons which are analogously connected to each other through a line 43.

In the example depicted in FIGS. 10 and 11, it is assumed that the plane of the lifting table 20 will always extend parallel to a surface formed by the rails 11 of the vehicle 1. If for certain reasons, for example when the vehicle does not stand parallel to the surface upon which the load is to be deposited, this parallel arrangement is not desired or maintained or if, in other words, the angle $\alpha_1$ should not correspond to the angle $\alpha_2$ and a selected angular difference must be maintained during the swinging or pivotal movement of the support arm 13, it is possible by supplying hydraulic fluid into the appropriate piston and cylinder unit to change the positions of the pistons 33 and 42 relative to the positions illustrated in FIG. 10. However, the preselected position will then always be maintained during swinging of the support arm 13 by operation of the mechanism in the manner described above.

While specific embodiments of the invention have been shown and described in detail to illustrate the application of the inventive principles, it will be understood that the invention may be embodied otherwise without departing from such principles.

What is claimed is:

1. A vehicular assembly for transporting large structural bodies such as prefabricated concrete enclosures comprising: vehicle means; a longitudinal support arm having a first and a second end and pivotally mounted at said first end for pivotal movement relative to said vehicle means about a first axis extending transversely to the longitudinal direction of said support arm; a support device for engaging a load to be transported pivotally mounted at said second end of said support arm for pivotal movement about a second axis parallel to said first axis; actuating means operatively engaged between said vehicle means and said support arm for driving said support arm about said first axis to transport a load; first fluidic piston-cylinder means pivotally interconnected between said support arm and said vehicle means at said first end of said support arm; second fluidic piston-cylinder means pivotally interconnected between said support arm and said support device at said second end of said support arm; and means operatively interconnecting said first and said second fluidic piston-cylinder means in fluid communication with each other to maintain said support device in a desired orientation relative to said vehicle means during operative movement of said support arm about said first axis; said second end of said support arm carrying said support device being mounted on said support arm for rotative movement relative thereto about the longitudinal direction thereof.

2. An assembly according to claim 1 wherein said support device comprises a lifting table formed of two longitudinal support members connected by a cross bar.

3. An assembly according to claim 2 wherein said lifting table is vertically adjustably supported relative to said second axis.

4. An assembly according to claim 3 wherein said lifting table is supported upon telescoping posts.

5. An assembly according to claim 1 further comprising an eccentrically arranged cylinder-piston unit for actuating rotative movement of said second end of said support arm about said longitudinal direction.

6. A vehicular assembly for transporting large structural bodies such as prefabricated concrete enclosures comprising: vehicle means; a longitudinal support arm having a first and a second end and pivotally mounted at said first end for pivotal movement relative to said vehicle means about a first axis extending transversely to the longitudinal direction of said support arm; a support device for engaging a load to be transported pivotally mounted at said second end of said support arm for pivotal movement about a second axis parallel to said first axis; actuating means operatively engaged between said vehicle means and said support arm for driving said support arm about said first axis to transport a load; first fluidic piston-cylinder means pivotally interconnected between said support arm and said vehicle means at said first end of said support arm; second fluidic piston-cylinder means pivotally interconnected between said support arm and said support device at said second end of said support arm; said first and second piston-cylinder means being congruently connected taken relative to said first and second axes, respectively; and means operatively interconnecting said first and second fluidic piston-cylinder means in direct fluid communication with each other to maintain said support device in a constant predetermined orientation relative to said vehicle means in response to operative movement of said support arm about said first axis.

7. An assembly according to claim 6 wherein said first and second piston-cylinder means comprise equal fluid volumes directly connected together.

8. A vehicular assembly for transporting large structural bodies such as prefabricated concrete enclosures comprising: vehicle means; a longitudinal support arm having a first and a second end and pivotally mounted at said first end for pivotal movement relative to said vehicle means about a first axis extending transversely to the longitudinal direction of said support arm; a support device for engaging a load to be transported pivotally mounted at said second end of said support arm for pivotal movement about a second axis parallel to said first axis; actuating means operatively engaged between said vehicle means and said support arm for driving said support arm about said first axis to transport a load; first fluidic piston-cylinder means pivotally interconnected between said support arm and said vehicle means at said first end of said support arm; second fluidic piston-cylinder means pivotally interconnected between said support arm and said support device at said second end of said support arm; with the distance between said first axis and the point at which said first piston-cylinder means is connected to said support arm being generally equivalent to the distance between said second axis and the point at which said second piston-cylinder means is connected to said support arm; and with the distance between said first axis and the point at which said first piston-cylinder means is connected to said vehicle means being generally equivalent to the distance between said second axis and the point at which said second piston-cylinder means is connected to said support device; and means operatively interconnecting said first and said second fluidic piston-cylinder means in direct fluid communication wtih each other to maintain said support device in a constant predetermined orientation relative to said vehicle means in response to operative movement of said support arm about said first axis.

9. An assembly according to claim 8 wherein said first and second piston-cylinder means comprise equal fluid volumes directly connected together.

* * * * *